United States Patent [19]

Winson

[11] Patent Number: 4,659,243

[45] Date of Patent: Apr. 21, 1987

[54] FOUNTAIN TYPE APPLICATOR FOR INK OR THE LIKE AND CARTRIDGE THEREFOR

[76] Inventor: John P. Winson, c/o Diagraph Corporation, P.O. Box 520, Herrin, Ill. 62948

[21] Appl. No.: 723,092

[22] Filed: Apr. 15, 1985

[51] Int. Cl.[4] ..... B05C 17/02; B05C 1/10

[52] U.S. Cl. ..... 401/197; 401/134; 401/150; 401/135; 401/208

[58] Field of Search ..... 401/132, 133, 134, 135, 401/208, 197, 150, 206

[56] References Cited

U.S. PATENT DOCUMENTS

| | | | |
|---|---|---|---|
| 1,657,033 | 1/1928 | Pollock | 401/134 |
| 1,671,125 | 5/1928 | Pollock | 401/134 |
| 2,932,045 | 4/1960 | Rabelow | 401/186 |
| 2,965,911 | 12/1960 | Hempel et al. | 401/206 X |
| 3,186,024 | 6/1965 | McLemore | 401/150 |
| 3,228,057 | 1/1966 | Parrish | 401/133 |
| 3,234,918 | 2/1966 | Gigli | 401/134 |

FOREIGN PATENT DOCUMENTS

| | | | |
|---|---|---|---|
| 344823 | 4/1960 | Switzerland | 401/135 |
| 954301 | 4/1964 | United Kingdom | 401/134 |

*Primary Examiner*—Steven A. Bratlie

*Attorney, Agent, or Firm*—Senniger, Powers, Leavitt and Roedel

[57] ABSTRACT

A fountain type applicator for ink or the like having a cartridge handle for containing the ink, an applicator having a roller and a threaded extension received in a threaded recessed end forming a seal in one end of the cartridge, the applicator being passaged for flow of ink from the cartridge to the roller. The extension has a tubular piercing member truncated at its distal end to form a cutting edge for penetrating a central region of the bottom of the recess in the cartridge to establish communication from the cartridge through the tubular piercing member to the roller.

3 Claims, 5 Drawing Figures

FOUNTAIN TYPE APPLICATOR FOR INK OR THE LIKE AND CARTRIDGE THEREFOR

BACKGROUND OF THE INVENTION

The present invention relates to liquid applicators and, more particularly, to a fountain type applicator for ink or the like provided with a one-time use cartridge for containing the liquid to be supplied to the applicator, and the one-time use cartridge per se.

PRIOR ART

Reference may be made to U.S. Pat. Nos. 2,932,045, 2,965,911 and 3,186,024 as prior art.

SUMMARY OF THE INVENTION

Among the several objects of this invention may be noted the provision of an improved applicator of the class described including a one-time use cartridge containing the liquid, such as ink, to be spread by the applicator, adapted for supply of the cartridge with the liquid sealed therein, easy attachment of the cartridge to the applicator with accompanying piercing of the cartridge for delivery of the liquid, and easy removal of the spent cartridge; and the provision of an improved one-time use cartridge for the purpose described.

In general, an applicator of this invention comprises a head, an applicating member carried by the head for applying the liquid, such as ink, a cartridge detachably secured to the head for holding a supply of the liquid and forming a handle on the head, the head having a passage for the flow of liquid from the cartridge to the applicating member, the head having a threaded extension for attachment with the cartridge in position to serve as a handle. The cartridge comprises an elongate receptacle for containing the liquid and is threaded recess at one end for threadedly attaching it to the extension. The cartridge has an end closure at its said threaded end, the end closure having a portion adapted to be punctured for forming an opening therein. The extension has a tubular piercing member engagable with said portion when the cartridge is threadedly attached to the extension for puncturing it to establish communication from the cartridge to the tubular piercing member for flow of liquid from the cartridge through the tubular piercing member, the latter being in communication with the liquid for flow of the liquid therefrom through the passage.

The tubular piercing member preferably has a distal end portion truncated at an angle to act as a rotary cutter to facilitate puncturing said portion of the end closure when the cartridge is threaded on the extension. The end closure is preferably of a reduced thickness in the portion to be punctured and the area surrounding the portion is stiffened to assist in puncturing. Also, the end closure is held in the cartridge in such a way as to prevent axial movement away from the extension as it is threaded into the cartridge, again, to assist in the puncturing of said portion of the end closure.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
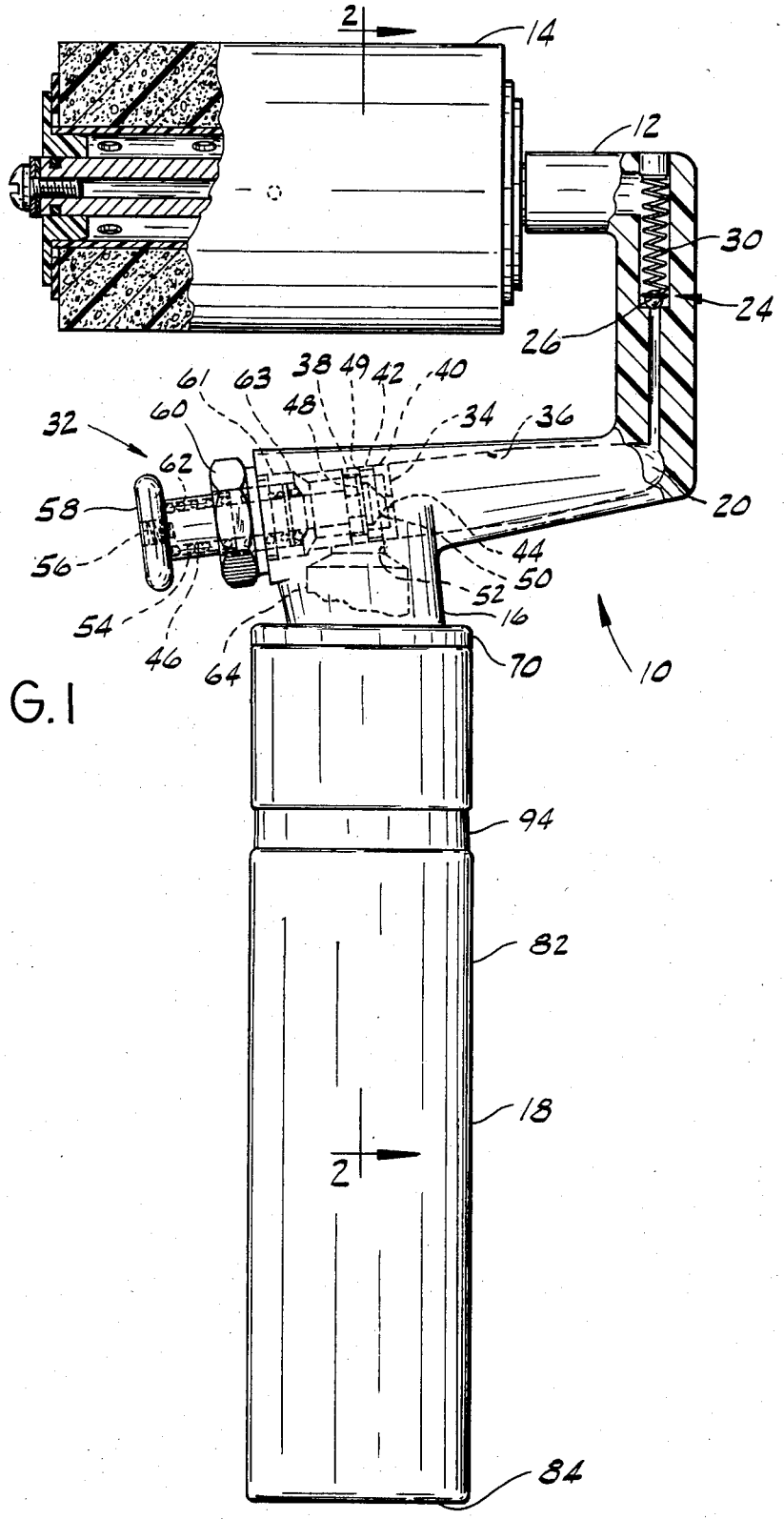
FIG. 1 is a plan view of a roller-type applicator of the present invention partially cut away in the area of a support arm of the extension and in the roller.

Referring to the drawings, there is generally indicated at 10 an applicator of this invention comprising a head 12 supporting a roller 14, and having an extension 16 which is threaded into a cartridge generally designated 18.

The head 12, preferably made of plastic, is provided with a contoured passageway 20 which provides for communication from the interior of the cartridge 18 with the interior surface 22 of the roller 14. The latter is made of a porous material and thus adapted to convey the liquid to its surface where it can be applied to a stencil or the like. A check valve 24 is provided which allows ink to flow from the cartridge 18 to the roller 14, but not from the roller to the cartridge. The valve 24 is a ball valve which includes a ball 26 biased on to a valve seat 28 by a spring 30.

Also disposed in the passageway 20 is a metering valve 32 for pumping a measured amount of ink from the cartridge 18 to the roller 14. The valve 32 has a plunger 34 slidingly received in a cylindrical bore 36 forming a portion of passageway 20. The plunger 34 has two cylindrical sealing surfaces 38 and 40 separated by a reduced diameter cylindrical surface 42 which together form a sliding seal with the bore 36. The end of the plunger 34 has a hole 44 which communicates with an interior cylindrical opening in the rear of the plunger. A rod 46 is held by a spring clip 48 having a plurality of fingers which support it on a shelf 49 in the interior of the plunger in spaced relation such that there is a flow path for ink through the plunger when it is seated in its retracted position, as shown. The spring clip 48 is disposed in a reduced diameter portion of the rod 46 for limited axial movement such that its conical end portion 50 can close off the hole 44 when the plunger 34 is pushed into the bore 36.

The valve 32 is closed, although not completely, when the plunger 34 is disposed over a passageway 52 forming part of passageway 20 which enters the bore 36 at an angle. When the plunger is in this essentially closed position there is still a reduced cross-sectional area path of flow for the ink along the rod 46, through the spring clip 48, around the conical portion 50 and out through the hole 44. However the pressure on the ball valve 24 by the spring 30 prevents the continous flow of ink to the roller 14 until the plunger 34 pushed in to increase the pressure to overcome the force of spring 30.

The plunger 34 is biased in the closed position, as shown, by a spring 54. The opposite end 56 of rod 46 is threaded into a cap 58 slidingly received in an externally threaded cylindrical member 60 threaded into the end of bore 36. The spring 54 has one end received in a cylindrical cavitity 62 of the cap 58 and its opposite end rests on a washer 61 supported on an O-ring 63 in the cylindrical interior cavity of the member 60 to thus bias the plunger 34 to its position over the opening of passageway 52 into the bore 36, to reduce the flow of ink.

Interconnected to the passageway 52 is a further passageway 64, also forming part of passageway 20, and which is defined in an extension 66 of the head 12. Extension 66 is cylindrical and has an externally threaded end portion 68 with an annular flange 70 at the inner end thereof. This flange 70 acts as a stop for the extension when it is threaded into the cartridge 18 by engaging the upper rolled-over or swaged edge 72 of the cartridge.

In the lower end of the extension 66 is a cylindrical insert or plug 74, also made of plastic, which is cemented or otherwise suitably fixed in the end of the passageway 64. Fixed in a central bore 76 in the insert 74, as by being molded therein, is a metal (such as brass) tubular piercing member or rotary cutter 78. The central bore of this member 78, indicated at 79, forms part of the passageway 20 and is in communication with the passageway 64 in the extension 66. The outer end of the tip 80 of the tubular member 78 is truncated at an angle so that it has a relatively sharp cutting edge as indicated at 80*a*. An angle of about 15° to a plane perpendicular to the axis of the tubular member has been found quite satisfactory for the purpose, and it is believed it may range from about 10° to about 20°. The tubular member 78 has a tapered body 78*a*, more particularly a conical body, with the cylindrical tip 80 of relatively small diameter extending out from the small end of the body.

The cartridge 18 comprises an elongate cylindrical sheet metal (e.g., aluminum) can 82 having an integral bottom (outer) end closure 84. It is so shaped and dimensioned as to serve as a handle for the applicator when attached thereto, i.e., when attached to the extension 66. Fitted in the can at its open end is a cup-shaped insert or closure member 86 preferably made of a suitable plastic such as polypropylene. This insert has a cylindrical wall 88 having a close sliding fit in the can; a bottom 90 which constitutes an end closure for the cartridge, and a depending skirt 91 having a flared outer periphery. Wall 88 is internally threaded as indicated at 92, the insert thereby defining an internally threaded recess by means of which the cartridge may be threaded on the threaded extension 66 of the applicator.

The can 82 is formed with an annular pressed-in groove 94 spaced from its open end providing an annular shoulder 96 facing toward that end. The cup-shaped insert 86 is inserted in the can, after the can has been loaded with the supply of ink, to the point where the insert bears around the inner end of the skirt 91 against this shoulder. The skirt 91 has a force fit in the reduced-diameter band of the can formed by the groove 94. The spacing of the shoulder from the end of the can and the length of the insert are such that the can has a portion extending beyond the rim of the insert at the open end of the can, and this is rolled over or swaged as indicated at 72 on the rim of the insert to hold it in the can.

Figure 2:
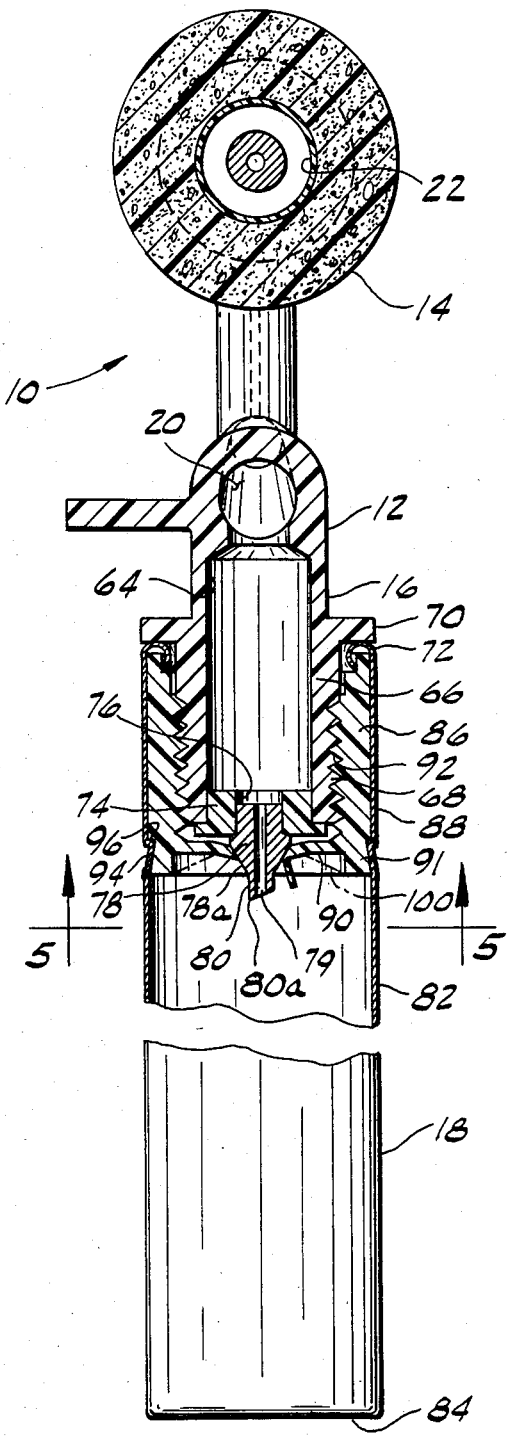
FIG. 2 is a cross-sectional view in the direction of line 2—2 of FIG. 1, showing the tubular piercing or cutting member penetrating the end closure.
Figure 3:
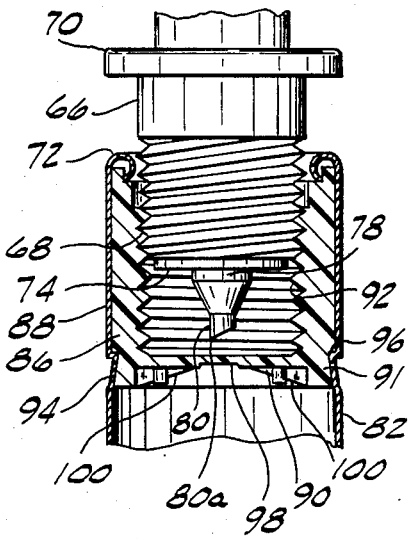
FIG. 3 is a partial cross-sectional view similar to FIG. 2, but illustrating the cartridge only partially threaded on to the extension before penetration of the end closure of the cartridge by the tubular piercing.
Figure 4:
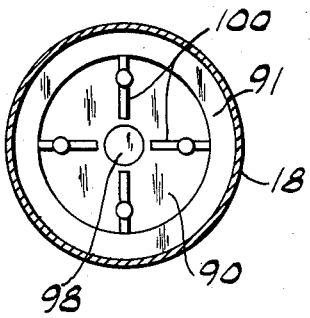
FIG. 4 is a cross-sectional view in the direction of line 4—4 of FIG. 3, showing the inner end of the end closure.
Figure 5:
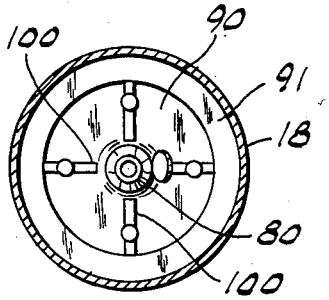
FIG. 5 is a cross-sectional view in the direction of line 5—5 of FIG. 2, showing the inner end of the end closure after it has been punctured.

The bottom 90 of the cup-shaped insert 86 has a central circular region 98 constituting an area to be pierced or punctured, which is preferably of reduced thickness so as to be relatively thin to aid in puncturing or cutting it. Also, the area surrounding the central region 98 is stiffened, such as by adding webs 100, also to assist in the piercing out of the central region. Thus, as the extension 66 is threaded down (relatively) into the insert 86, the cutting edge 80*a* of the tip 80 of the tubular member 78, which is off-center (i.e., offset from the axis of the member 78 and extension 66) due to the inclination of the end of the tip, cuts into the central area 98 around a relatively small diameter circle and eventually penetrates the central region to puncture it and effect communication of the interior of the cartridge 18 with the central bore of the member 78. The relative measurements of the member 78, insert 86 and extension 66 along their mutual central axis are preferably such that when the cartridge is threaded completely onto the extension until it stops, the central portion, which has been substantially severed, still has a small circular piece of material 102 integrally joined to the bottom 90 of the insert, as best seen in FIGS. 2 and 5. This prevents the piece from becoming completely detached and possibly clogging the flow of ink from the cartridge, and the piece is also held aside so as not to block the passage in the punch. Also, the tapered body 78*a* of member 78 comes into sealing engagement with the edge of the bottom 90 all around the circular hole punched in the bottom 90 and this tends to prevent flow of ink into the insert 86 where it might foul the threads. Thus, when the cartridge is empty, it may be readily removed and replaced with a fresh cartridge.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An applicator for liquid such as ink comprising a cartridge for the liquid and a head on the cartridge carrying a roller for application of the liquid, the head having an externally threaded tubular extension on which the cartridge is threaded at one end, the cartridge being shaped and dimensioned to serve as a handle for the applicator, the head having a passage for delivery of liquid from the tubular extension to the roller and means adjacent said extension operable by a user while the user is grasping the cartridge for pumping liquid from the cartridge through said passage to the roller, the cartridge comprising a cylindrical sheet metal can having an outer end closure at its end opposite its said one end, a cup-shaped plastic insert in said can at its said one end, said cup-shaped insert being internally threaded for being threadedlly assembled with said tubular extension, said extension having a plug secured in its outer end, said plug having a central bore, a tubular metal piercing member secured in said bore and extending outwardly from the plug, said cup-shaped insert having a bottom with a relatively thin central portion for being punctured by the piercing member on the threaded assembly of the insert and the extension, the can having an annular pressed-in groove spaced from its said one end forming an inwardly directed band around the can, the cup-shaped insert having a skirt extending down from its bottom having a close fit in the band, the cup-shaped insert at its bottom around the skirt bearing against the band, said piercing member having a tapered body and a cylindrical tip of relatively small diameter extending from the small end of the tapered body for puncturing said relatively thin central portion to provide an opening in the bottom of said insert, the tapered body coming into wedging sealing engagement with the edge of the bottom of the insert all around the opening thus formed in said central portion, said can having a portion extending beyond the rim of the cup-shaped insert at said one end of the can and swaged over on the rim of the insert to hold it in the can, said extension having a flange engageable with said swaged-over portion of the can acting as a stop for the extension when it is threaded into the insert to limit the threading of the extension in the insert to a point where the tapered body of the piercing member is wedged in said opening and said cylindrical tip of the piercing member is inward of the bottom of the insert.

2. An applicator as set forth in claim 1 wherein the tip of said piercing member has a distal end portion at an angle of about 15° to a plane perpendicular to the axis thereof.

3. An applicator as set forth in claim 2 wherein said cup-shaped insert has webs extending radially inwardlly from the skirt toward said central portion of its bottom for stiffening the bottom around said central portion.

* * * * *